US007021705B1

(12) United States Patent
Niermeyer et al.

(10) Patent No.: US 7,021,705 B1
(45) Date of Patent: Apr. 4, 2006

(54) CHILDREN'S CHAIR

(75) Inventors: Eric P. Niermeyer, Vestal, NY (US); William FitzGerald, Vestal, NY (US); Douglas Sherman, Owego, NY (US); Walter Klinger, Owego, NY (US)

(73) Assignee: Stakmore Co., Inc., Owego, NY (US)

( * ) Notice: Subject to any disclaimer, the term of this patent is extended or adjusted under 35 U.S.C. 154(b) by 0 days.

(21) Appl. No.: 10/271,891

(22) Filed: Oct. 15, 2002

(51) Int. Cl.
*A47C 4/00* (2006.01)
*A47C 1/12* (2006.01)

(52) U.S. Cl. ..... 297/55; 297/335

(58) Field of Classification Search ..... 297/58, 297/55, 59, 332, 333, 335
See application file for complete search history.

(56) References Cited

U.S. PATENT DOCUMENTS

| | | | | |
|---|---|---|---|---|
| 816,853 | A * | 4/1906 | Eisele | 279/53 |
| 1,836,108 | A | 12/1931 | Buffington | |
| 1,873,763 | A | 8/1932 | Kux | |
| 2,044,473 | A | 6/1936 | Geller | 155/141 |
| 2,174,224 | A | 9/1939 | Geller | 155/130 |
| 2,308,256 | A | 1/1943 | Wilkinson | 311/96 |
| 2,636,549 | A | 4/1953 | Geller | 155/83 |
| 2,779,394 | A * | 1/1957 | Csorgo | 297/53 |
| 2,843,186 | A * | 7/1958 | Spencer | 297/58 |
| 2,930,431 | A | 3/1960 | Geller | 155/166 |
| 2,936,026 | A | 5/1960 | Kaufman | 155/141 |
| 3,021,175 | A | 2/1962 | Norquist | 297/58 |
| 3,030,141 | A | 4/1962 | Geller | 297/60 |
| 3,042,447 | A | 7/1962 | Wilkinson | 297/58 |
| 3,199,915 | A * | 8/1965 | Hamilton | 297/42 |
| 3,381,998 | A * | 5/1968 | Cheshier et al. | 279/124 |
| 3,429,611 | A * | 2/1969 | Van Ryn | 297/58 |
| 3,451,718 | A | 6/1969 | Kaufman et al. | 297/239 |
| 4,087,128 | A * | 5/1978 | Shepard | 297/52 |
| 5,529,270 | A * | 6/1996 | Liu | 248/188 |
| 5,782,528 | A * | 7/1998 | Cioncada | 297/60 |
| 6,056,354 | A * | 5/2000 | Tseng | 297/56 |
| 6,062,639 | A | 5/2000 | Hill | 297/16.1 |
| 6,099,073 | A | 8/2000 | Bruschi | 297/59 |
| 6,386,627 | B1 * | 5/2002 | Tsai | 297/16.1 |

FOREIGN PATENT DOCUMENTS

DE 2733125 A1 * 7/1977

OTHER PUBLICATIONS 3 pages of pictures from the internet of Stakmore Chairs; undated; admitted prior art.

* cited by examiner

*Primary Examiner*—Peter M Cuomo
*Assistant Examiner*—Sarah B. McPartlin
(74) *Attorney, Agent, or Firm*—MacCord Mason PLLC

(57) ABSTRACT

A child safety, folding seat includes support members pivotally joined to a seat member. The seat member pivots between folded and unfolded conditions, and a lock locks the seat in the unfolded condition when the seat members is unfolded. Preferably, the lock is spaced rearwardly on an underside of the horizontal seat member sufficiently so that a child on the seat will not normally be able to reach under the seat and inadvertently disengage the lock and the lock automatically locks when the seat member is pivoted to the horizontal position.

6 Claims, 3 Drawing Sheets

CHILDREN'S CHAIR

BACKGROUND OF THE INVENTION

The present invention relates to improvements in folding chairs to make them less risky for use by children.

Folding chairs have been around for many years including numerous chairs manufactured for decades by the assignee of the present application. Examples of prior patents belonging to the assignee are as follows:

| | |
|---|---|
| 3,021,175 | Norquist |
| 3,451,718 | Kaufman |
| 3,030,141 | Geller |
| 2,936,026 | Kaufman |
| 2,930,431 | Geller |
| 3,042,447 | Wilkinson |
| 2,636,549 | Geller |
| 2,308,256 | Wilkinson |
| 2,174,224 | Geller |
| 2,044,473 | Geller |
| 1,873,768 | Kux |
| 1,836,108 | Buffington |
| 880,087 | British Patent |
| 793,717 | Canadian Patent |

Folding chairs have the benefit of reduced volume occupied by the chair for storage. When folded, the chair can be deployed for use by unfolding. As folded, the chair takes up less volume, and the various components of the chair tend to be somewhat aligned. In the unfolded condition at least a horizontal seat platform is supported by generally vertically aligned legs. In the process of folding and unfolding, the movement of the various components to the use position causes the closure of numerous gaps between the supporting and supported components. The closure of those gaps creates a pinch point which, particularly in the case of children, may cause a finger or other body part to be pinched, causing injury. When the chair is being unfolded, care can be taken to avoid pinching. However, children using the unfolded chair can sometimes be rambunctious or use the chair in unexpected ways, causing the chair to unexpectedly begin to fold while the child is in it. If this happens, the pinch point reappears with the attendant risk of pinching and injury to the child. Accordingly, there is a need in the art for a folding chair in which the folding chair can be used by a child and the risk of the chair folding or unfolding uncontrolled is reduced.

SUMMARY OF THE INVENTION

The invention fulfills one or more of these needs by providing a child safety, folding seat having support members pivotally joined to a seat member which is pivotable between folded and unfolded conditions, and a lock having portions on the seat member and the support members locking the seat in the unfolded condition when the seat member is pivoted to the unfolded condition with respect to the support members.

Preferably, the lock is spaced rearwardly on an underside of the seat member sufficiently so that a child on the seat will not normally be able to reach under the seat and inadvertently disengage the lock. Also preferably, the lock automatically locks when the seat member is pivoted to the horizontal position.

The lock may be made up of two portions that engage to lock, and the support members include a cross brace that has one portion of the lock and the seat member has the other portion. In one embodiment the portion of the cross brace is a catch. The portion on the seat member is preferably a spring-loaded pivoting mechanism on an underside of the seat member.

The invention also provides a method of using a folding seat including unfolding the seat from an upright, compact configuration to an unfolded configuration with a substantially horizontal seat member, and locking the seat member to a support member in the unfolded condition when the seat member is pivoted to the unfolded condition with respect to the support members. Preferably, locking takes place automatically when the seat member is unfolded. Locking may include engaging a lock portion on a cross brace with a lock portion on the seat member. Locking may include engaging a spring-loaded pivoting mechanism on an underside of the seat with a support.

In one embodiment locking includes passing a spring-loaded pivoting mechanism on an underside of the seat member with catch on a brace extending between upright members.

The method may also include unlocking the lock and refolding the seat.

DESCRIPTION OF AN EXAMPLE OF THE INVENTION

Figure 1:
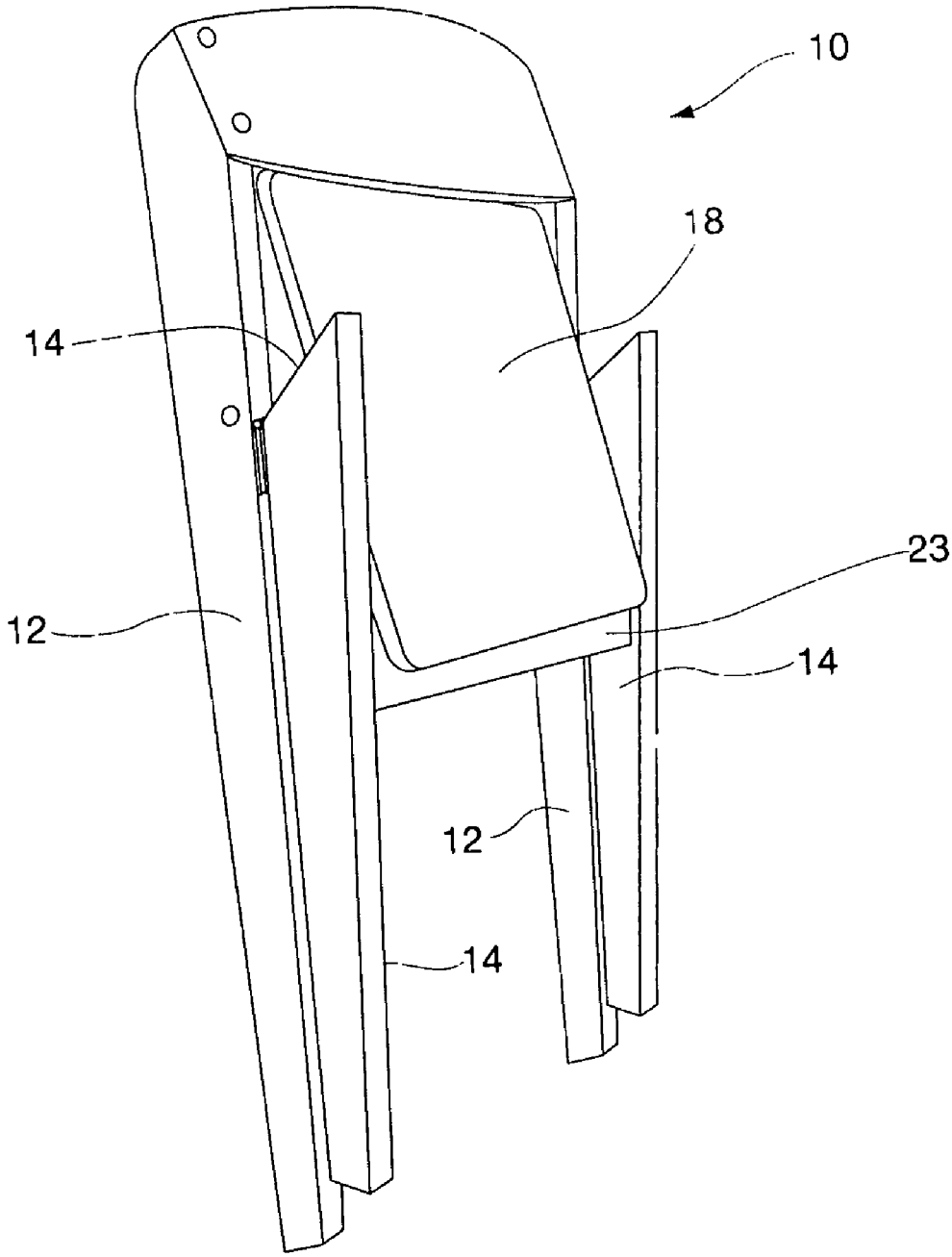
FIG. 1 is a perspective view of the chair a folded condition.
Figure 2:
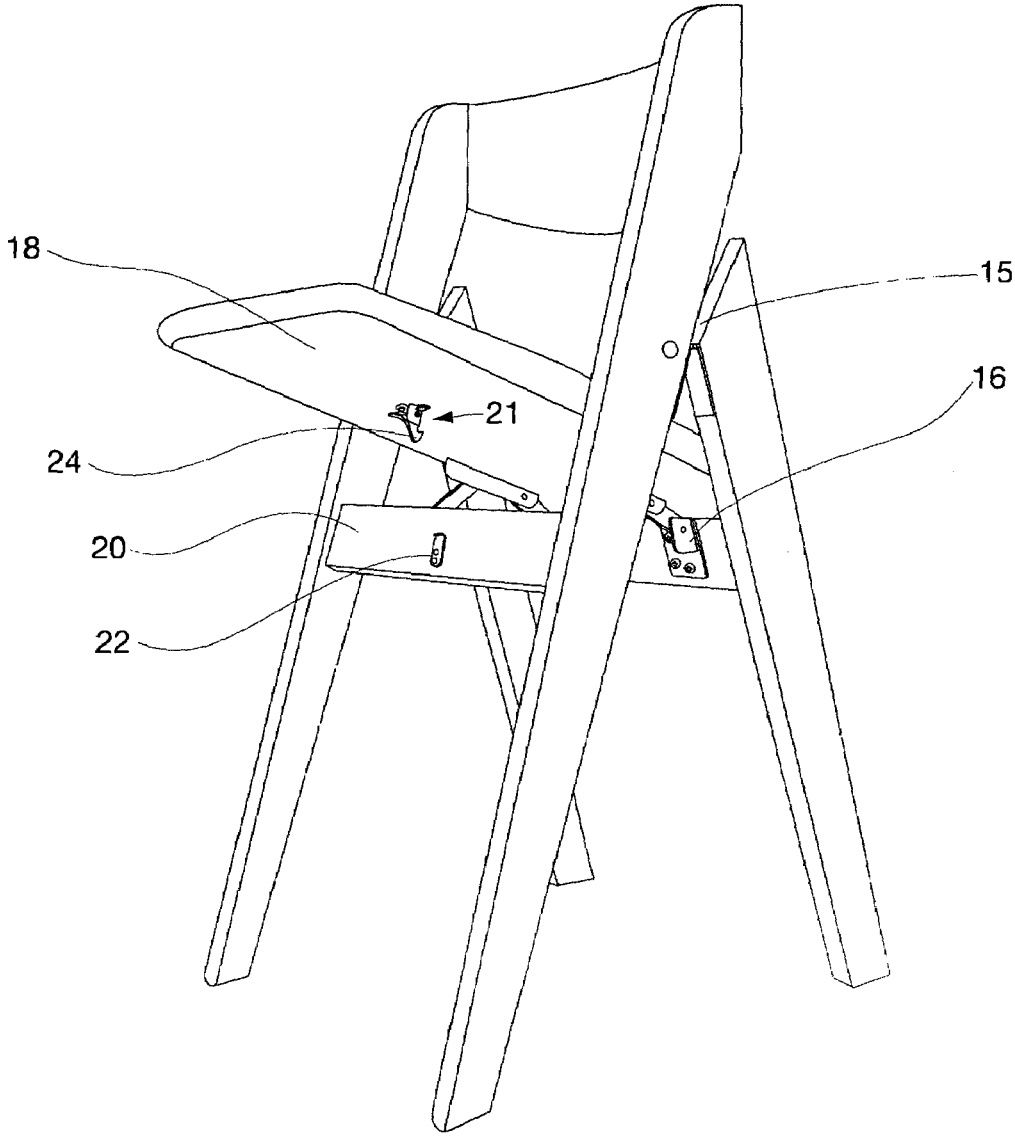
FIG. 2 is a view of the chair substantially unfolded.

As seen in FIG. 1, a folding chair 10 in a folded position includes a pair of generally vertically aligned side posts 12 and rear supporting legs 14. Side posts 12 are joined by a front brace 20 and legs 14 are joined by a rear brace 23 to make up support members. A linkage mechanism 16 (as seen in FIG. 2) connects the side posts 12 and rear legs 14 in a folding arrangement. The linkage mechanism is conventional and can be as described in the aforementioned U.S. Pat. No. 3,021,175 to Norquist, the entire disclosure of which is incorporated herein by reference or commercially available style number 970 available from Stakmore Co., Inc. of Owego, N.Y. As seen in Norquist and the Figures of this application, the folding chair has two image points connecting the top of the back legs to a point on the front legs to form a pivoting position for folding of the chair from the closed to open position and vice versa. The chair may also have hinges attaching the front leg cross brace and the rear leg cross brace to the seat member, which causes the front legs to fold towards the rear legs as the seat member is raised and front legs to move away from the rear legs as the seat member is pushed down to bring the chain into a functional seating position. The linkage arrangement 16 also connects a rear bottom of a seat portion 18 to rear brace 21. The seat 18 pivots between an upright, aligned condition with respect to the posts 12 and legs 14 (as seen in FIG. 1) and a horizontal position which is generally transverse to those supports (FIG. 2 shows transition to this position). In the use position, the horizontal seat comes into contact with the horizontal brace 20 extending between the two side posts 12. At their tops, the posts 12 and legs 14 come together at a crotch 15 which opens when the chair is folded, and closes when the chair is unfolded, possibly causing pinching of a finger or the like that may be in the crotch or pinch point.

Figure 3:
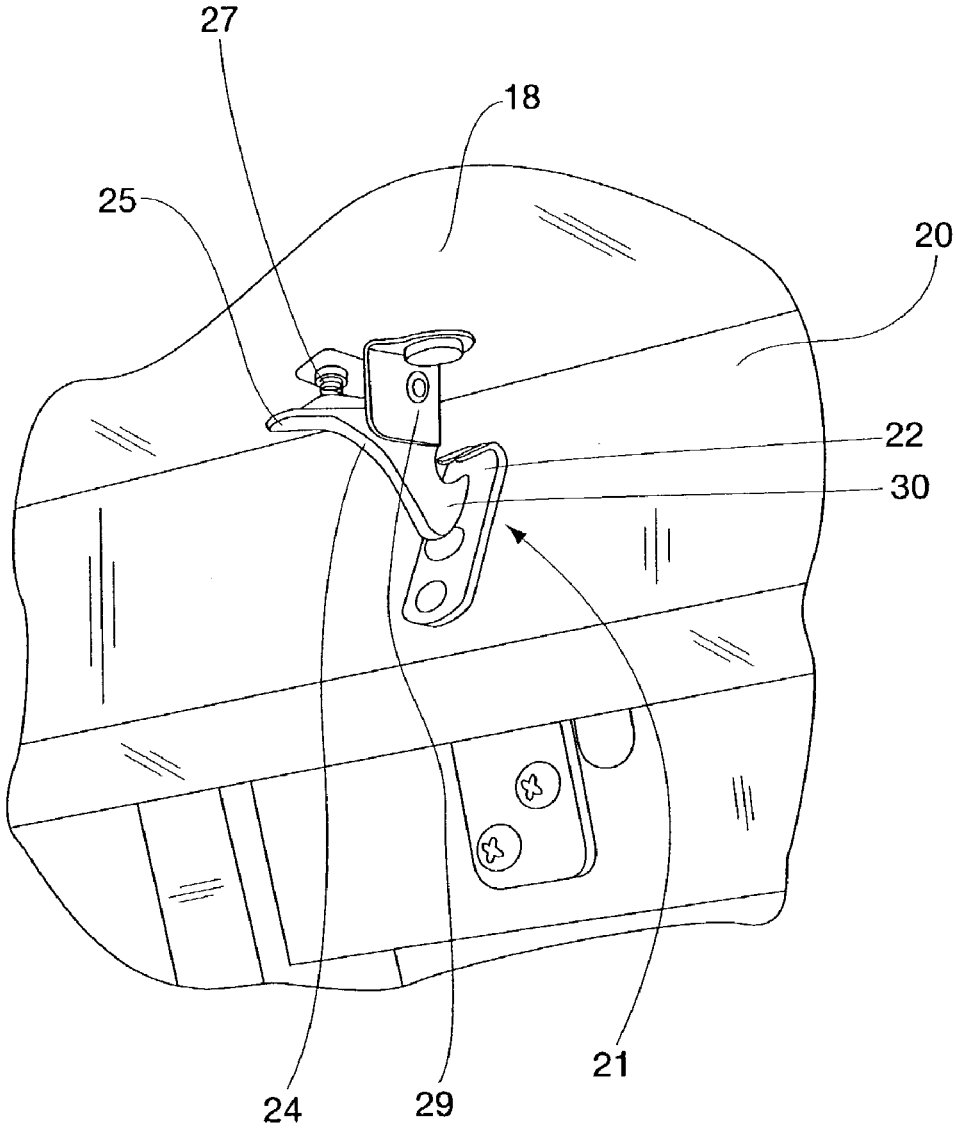
FIG. 3 is an enlarged view of the locking mechanism with the seat fully unfolded.

A lock 21 locks the seat 18 to the horizontal brace 20 when in the fully unfolded position and does so automatically. As seen in FIGS. 2 and 3, lock 21 includes a catch 22 on the horizontal brace 20 and a locking mechanism 24 mounted on the bottom of the seat 18. The mechanism 24 is formed as a leer that is spring-loaded to a closed position by spring 27 and can be opened by finger pressure on a tab 25. The lever pivots about pivot point 29. When the seat 18 is rotated downwardly onto the horizontal brace 20, the mechanism 24 passes the catch 22 and a leading edge 30 of the mechanism 24 rides over the catch 22 causing pivoting about pivot 29 in opposition to spring 27. When the mechanism 24 clears the catch 22, it attaches to the catch 22 to cause the engagement of the seat 18 to the brace 20.

Thus, when the child uses the chair after it has been so engaged, the seat 18 will not inadvertently tip up and open the pinch points for possible damage to the child.

The chair can be refolded by pressing on the tab 25, releasing the locking mechanism and pivoting the seat back to the position shown in FIG. 1.

It is preferred that the locking mechanism be positioned rearwardly, under the seat 18 so far that the child will not normally disengage the mechanism 24 simply by reaching to the bottom face of the seat. Rather, the mechanism 24 is farther back to engage the cross bar, and a conscious effort is normally needed to reach to disengage the mechanism 24 and allow folding of the chair.

As a result, the child's possibly rambunctious movement while seated in the chair will not cause the chair to fold, but rather the chair is locked in the unfolded state by the mechanism's engagement to the catch 22.

The chair is typically made in a small size suitable for a toddler or small child, but may also be made in other sizes.

While the locking mechanism has been shown in a preferred embodiment, at the configurations can also be used, including reversing the relative positions of catch and mechanism. Also, the lock could be positioned to engage at the rear of the cross member. Other means retain the seat in the open position may also be used, but it is preferable that no manipulation need take place to cause the locking.

What is claimed is:

1. A child safety, folding seat comprising support members with a cross brace extending between the support members, and the support members being pivotally joined to a seat member, the seat member having a bottom, a front, and a rear and being pivotal between folded and unfolded conditions, and a lock having a first portion on the bottom of the seat member substantially midway between the front and the rear and a second portion proximate a central location of the cross brace locking the seat in the unfolded condition when the seat member is pivoted to the unfolded condition with respect to the support members, so that the first portion is located at a location so that a child on the seat will not normally be able to reach under the seat and inadvertently disengage the lock wherein the lock is made up of two portions that engage to lock, the support members include a cross brace that has one portion of the lock proximate a central portion of the cross brace and the seat member has the other portion proximate a central portion of the seat member and wherein the portion on the cross brace is a catch made separately from the cross brace and affixed to the cross brace.

2. A child safety, folding seat as claimed in claim 1 wherein the lock automatically locks when the seat member is pivoted to a horizontal position.

3. A child safety, folding seat as claimed in claim 1, wherein the portion on the seat member is a spring-loaded pivoting mechanism on an underside of the seat.

4. A child safety, folding seat comprising two forward and two rear support members pivotally joined together, a seat member having a front and a rear and being pivotally joined to the rear support members and pivotable between folded and unfolded conditions.

a cross brace extending between the forward support members, and a lock, including a spring loaded pivoting mechanism, locking the seat in the unfolded condition when the seat member is pivoted to the unfolded condition with respect to the support members, the lock being made up of two portions that engage to lock, the cross having one portion of the lock and the seat member having the other portion, wherein the portion of the lock on the seat member is located substantially midway between the front and the rear of the seat member so that a child on the seat will not normally be able to reach under the seat and inadvertently disengage the lock, and the lock automatically locks when the seat member is pivoted to a horizontal position and wherein the portion of the cross brace is a catch made separately from the cross brace and affixed to the cross brace.

5. A child safety, folding seat as claimed in claim 4, wherein the spring-loaded pivoting mechanism is on the underside of the seat.

6. A child safety, folding seat comprising support members with across brace extending between the support members, and the support members being pivotally joined to a seat member, the seat member having a bottom, a front, and a rear and being pivotally between folded and unfolded conditions, and a lock having a first portion on the bottom of the seat member substantially midway between the front and the rear and a second portion proximate a central location of the cross brace locking the seat in the unfolded condition when the seat member is pivoted to the unfolded condition with the respect to the support members, so that the first portion is located at a location so that a child on the seat will not normally be able to reach under the seat and inadvertently disengage the lock wherein the lock is made up of two portions that engage to lock, the support members include a cross brace that has one portion of the lock at a central portion of the cross brace and the seat member has the other portion at a central portion of the seat member, wherein the portion on the cross brace is a catch made separately from the cross brace and affixed to the cross brace.

* * * * *

UNITED STATES PATENT AND TRADEMARK OFFICE

CERTIFICATE OF CORRECTION

PATENT NO. : 7,021,705 B1
APPLICATION NO. : 10/271891
DATED : April 4, 2006
INVENTOR(S) : Niermeyer et al.

It is certified that error appears in the above-identified patent and that said Letters Patent is hereby corrected as shown below:

In the Abstract, Line 4, members should be “member”.

Column 2, Line 2, after the word portions, of should be “on”

Column 2, Figure 1, line 28, after the word chair, insert “in”

Column 2, Line 49, the word image should be “hinge”

Column 3, Line 8, leer should be “lever”

Column 4, Line 23, after the word cross, insert “brace”

Column 4, Line 40, across should be “a cross”

Signed and Sealed this

First Day of August, 2006

JON W. DUDAS
*Director of the United States Patent and Trademark Office*

UNITED STATES PATENT AND TRADEMARK OFFICE

CERTIFICATE OF CORRECTION

PATENT NO. : 7,021,705 B1
APPLICATION NO. : 10/271891
DATED : April 4, 2006
INVENTOR(S) : Niermeyer et al.

It is certified that error appears in the above-identified patent and that said Letters Patent is hereby corrected as shown below:

On the title page item (57), Abstract, Line 4, members should be “member”

Column 2, Line 2, after the word portion, of should be “on”

Column 2, Figure 1, after the word chair, insert “in”

Column 2, Line 49, the word image should be “hinge”

Column 3, Line 8, leer should be “lever”

Column 4, Line 23, after the word cross, insert “brace”

Column 4, Line 40, across should be “a cross”

Signed and Sealed this

Fifth Day of September, 2006

JON W. DUDAS
*Director of the United States Patent and Trademark Office*